US009562298B2

(12) United States Patent
Chou et al.

(10) Patent No.: US 9,562,298 B2
(45) Date of Patent: Feb. 7, 2017

(54) ELECTRODEPOSITED COPPER FOIL

(71) Applicant: Chang Chun Petrochemical Co., Ltd., Taipei (TW)

(72) Inventors: Jui-Chang Chou, Taipei (TW); Kuei-Sen Cheng, Taipei (TW); Yao-Sheng Lai, Taipei (TW); Hsi-Hsing Lo, Taipei (TW); Yueh-Min Liu, Taipei (TW)

(73) Assignee: Chang Chun Petrochemical Co., Ltd., Taipei (TW)

( * ) Notice: Subject to any disclaimer, the term of this patent is extended or adjusted under 35 U.S.C. 154(b) by 173 days.

(21) Appl. No.: 14/486,107

(22) Filed: Sep. 15, 2014

(65) Prior Publication Data

US 2015/0267313 A1 Sep. 24, 2015

(30) Foreign Application Priority Data

Mar. 21, 2014 (TW) ..... 103110616 A

(51) Int. Cl.
*B21C 37/00* (2006.01)
*C25D 1/04* (2006.01)
*C25D 3/38* (2006.01)

(52) U.S. Cl.
CPC . *C25D 1/04* (2013.01); *C25D 3/38* (2013.01); *Y10T 428/12431* (2015.01)

(58) Field of Classification Search
None
See application file for complete search history.

(56) References Cited

U.S. PATENT DOCUMENTS 4,511,443 A * 4/1985 Goffman ..... C25C 1/12 205/585
5,171,417 A * 12/1992 DiFranco ..... C25D 3/38 428/544
5,840,170 A * 11/1998 Nagy ..... C25D 3/38 205/210
2001/0042686 A1* 11/2001 Taniguchi ..... C25D 1/04 428/606
2004/0157080 A1* 8/2004 Shinozaki ..... C25D 3/58 428/606
2010/0038115 A1* 2/2010 Matsuda ..... C25D 3/38 205/76
2012/0015206 A1* 1/2012 Kim ..... B32B 15/01 428/606

* cited by examiner

*Primary Examiner* — David Sample
*Assistant Examiner* — Nicholas W Jordan
(74) *Attorney, Agent, or Firm* — Polsinelli PC

(57) ABSTRACT

An electrodeposited copper foil having a texture coefficient of a plane (200) from 50 to 80%, based on the sum of the texture coefficients of a plane (111), the plane (200), a plane (220) and a plane (200) of the electrodeposited copper foil is provided. The electrodeposited copper foil is particularly suitable for use in the applications in printed circuit boards and lithium ion secondary batteries.

13 Claims, 2 Drawing Sheets

ELECTRODEPOSITED COPPER FOIL

REFERENCE TO RELATED APPLICATION

This application claims foreign priority under 35 U.S.C. §119(a) to Patent Application No. 103110616, filed on Mar. 21, 2014, in the Intellectual Property Office of Ministry of Economic Affairs, Republic of China (Taiwan, R.O.C.), the entire content of which Patent Application is incorporated herein by reference.

BACKGROUND OF THE INVENTION

1. Field of the Invention

The present invention relates to electrodeposited copper foils, and more particularly, to an electrodeposited copper foil suitable for use in a printed circuit board and rechargeable and discharge batteries.

2. Description of Related Art

A printed circuit boards (PCB), used as a critical equipment for various types of electrical devices and products, is capable of carrying an electronic element and being connected to an electrical circuit, such that a stable operating environment is provided. PCBs have a broad range of applications, including in the consumer, industry and national defense sectors. Moreover, the fabrication of a PCB involves the assembly of the industries of materials, electricity, mechanics, chemistry, and optics, and thereby sufficiently demonstrating the importance of PCBs to the economical development.

However, in the fabrication of a PCB, a copper foil is adhered onto a substrate, and then made into a circuit pattern. Nodules are usually formed on a surface of a copper foil, In the past, the ratio of line width/line interval is larger. However, as the manufacturing of lighter, thinner, shorter and smaller electronic products gradually become a trend, the requirement for the line width/line interval ratio gets stricter, i.e., the ratio has reached 2 mil/2 mil (i.e., 50 μm/50 μm), or even 1 mil/1 mil (i.e., 25 μm/25 μm). Therefore, even a very small nodule would cause short circuit in a PCB substrate, such that the nodules on a surface of a copper foil need to be removed.

Moreover, the need for lithium ion secondary batteries in the modern society is also increasing. A lithium ion secondary battery must have safety in use and a long battery life, in addition to having a good discharging property. Hence, the process of fabrication of a lithium ion secondary cell must be more rigorous and delicate.

The structure of a lithium ion secondary cell is obtained by reeling a positive electrode pole piece, a separator, and a negative electrode pole piece together, placing them into a container, injecting an electrolyte, and sealing to form a battery, wherein the negative electrode pole piece is composed of a negative electrode collector made of copper foil and a negative electrode active substance made of a carbon material and the like coating on a surface thereof. However, when the amount of copper nodules on the copper foil is excessive, the negative electrode active substance would be unevenly coated, or even the copper nodules would sometimes be stuck in the gaps of the coating die, causing the copper foil to break during coating, and thereby lowering the yield. The above issues are the current issues to be urgently resolved.

A copper foil may be divided into a rolled annealed copper foil or an electro deposited copper foil. The electrodeposited copper foil uses an aqueous solution of sulfuric acid and copper sulfate as an electrolyte, a titanium plate overlaid with an iridium element or an oxide thereof as a dimensionally stable anode (DSA), a titanium-made roller as a cathodic drum. A direct current is applied between the two poles, to electrically deposit the copper ions, which are in the electrolyte on the titanium-made roller, and then the deposited electrodeposited copper is peeled off from the surface of the titanium-made roller and continuously rolled up for producing the electrodeposited copper foil, wherein the surface of the electrodeposited copper foil in contact with the surface of the titanium-made roller is called "shiny surface (S surface)," and the reversed side is called "matte surface (M surface)." Usually, the roughness of the S surface of the electrodeposited copper foil depends upon the roughness of the surface of the titanium-made roller. Therefore, the roughness of the S surface is more constant, and the roughness of the M surface may be adjusted by controlling the conditions of the copper sulfate electrolyte.

Conventionally, an organic additive (for example, a low-molecular-weight gel (such as gelatin), hydroxymethyl cellulose (HEC) or polyethylene glycol (PEG)) or a sulfur-containing compound having a grain-refining effect (for example, sodium 3-mercaptopropane sulphonate (MPS), bis-(3-soldiumsulfopropyl disulfide) (SPS)) is added to a copper sulfate electrolyte to alter the crystalline phase of the electrodeposited copper foil.

Methods for reducing nodules are generally based on the approach of lowering the current density during electroplating to reduce the effect of point discharge. However, the decrease in the current density would bring about a reduction in the yield. Alternatively, the increase in the circulating quantity of the electrolyte, which allows the additive contained in the electrolyte to be more completely absorbed by activated carbon, would bring about an increase in the energy consumed during the production.

Accordingly, the development of an electrodeposited copper foil with reduced generation of nodules on a surface thereof, without compromising the production efficiency, is a current issue to be urgently resolved.

SUMMARY OF THE INVENTION

In view of the above deficiencies of the conventional technologies, the present invention provides an electrodeposited copper foil. The texture coefficient of a plane (200) of the electrodeposited copper foil is from 50 to 80%, based on the sum of the texture coefficients of a plane (111), the plane (200), a plane (220) and a plane (311) of the electrodeposited copper foil.

In another example, the texture coefficient of the plane (200) of the electrodeposited copper foil is from 62 to 76%, based on the sum of the texture coefficients of the planes (111), (200), (220) and (311) of the electrodeposited copper foil.

In one embodiment, the ratio of the texture coefficient of the plane (200) to the texture coefficient of the plane (111) ranges from 3 to 7.

In another embodiment, the ratio of the texture coefficient of the plane (200) to the texture coefficient of the plane (111) ranges from 3.88 and 6.76.

Further, in an example, the tensile strength of the aforesaid electrodeposited copper foil is between 30 to 40 kgf/$mm^2$.

In another embodiment, the aforesaid electrodeposited copper foil has an S surface and an opposing M surface, wherein the roughness of each of the S and M surfaces is lower than 2 μm.

In a further example, the thickness of the aforesaid electrodeposited copper foil is greater than or equal to 1 μm. Moreover, the number of the nodules at sizes ranging from 5 to 100 μm per square meter of the surface area of the electrodeposited copper foil is less than or equal to 5.

In an aspect, the number of the nodules at sizes ranging from 5 to 100 μm on a surface of electrodeposited copper foil provided by the present invention is less than or equal to 5. Further, in the electrodeposited copper foil, the ratio of the texture coefficient the plane (200) to the texture coefficient of the plane (111) ranges from 3 to 7.

In the example, in the electrodeposited copper foil, the ratio of the texture coefficient of the plane (200) to the texture coefficient of the plane (111) ranges between 3.88 and 6.76.

In another example, the tensile strength of the aforesaid electrodeposited copper foil is between 30 and 40 kgf/mm$^2$.

Further, in an embodiment, the aforesaid electrodeposited copper foil has an S surface and an opposing M surface, wherein the roughness of each the S and M surfaces is lower than 2 μm.

In another embodiment, the thickness of the aforesaid electrodeposited copper foil is greater than or equal to 1 μm.

The electrodeposited copper foil provided by the present invention has a completely different crystalline phase structure, which is capable of effectively lowering the generation of nodules on a surface of the copper foil. Further, the electrodeposited copper foil of the present invention has excellent tensile strength and rate of elongation. The surface roughness of each of the S and M surfaces is lower than 2 μm, such that it is suitable for use in a PCB and a lithium ion secondary battery.

BRIEF DESCRIPTIONS OF THE DRAWINGS

DETAILED DESCRIPTION OF THE PREFERRED EMBODIMENTS

The followings illustrate the detailed description of the present invention by using specific embodiments, so as to enable one of ordinary skill in the art to readily conceive the other advantages and aspects of the present invention from the content of disclosure of the present specification.

Electrodeposited copper foils may be widely applied to the fields of PCBs and lithium ion secondary batteries. In order to increase the capacitance of a lithium ion secondary battery, reduction of the thickness of a copper foil is a common approach, which may be conducted by thinning the thickness of the copper foil with carrier foil to 3 μm, or even 1 μm. On the other hand, the thickness of the copper foil for use in a high capacity lithium ion battery may be 6 μm or 8 μm. In order to cope with a higher wiring density, line width and interval of flexible PCB keeps decreasing and thinner thickness of copper foil is selected as well. The common specification of the current flexible PCB substrate is 12 μm in thickness. For the sake of convenience, electrodeposited copper foils at sizes ranging from 6 μm to 12 μm are used as representative examples to illustrate the advantages and effects of the present invention, but they are not intended to limit the scopes of the examples.

Figure 1:
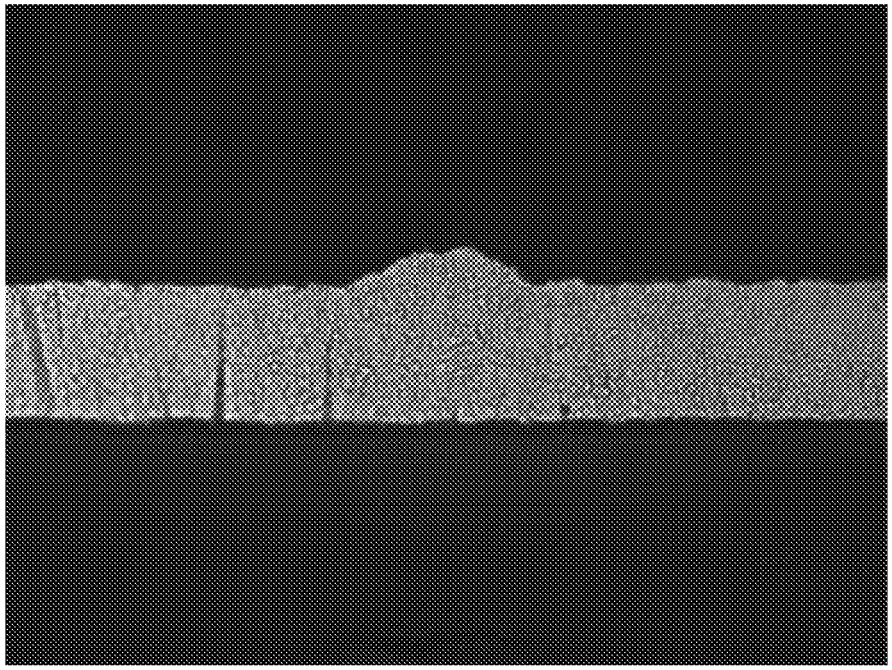
FIG. 1 is a cross-sectional enlarged view showing the nodules formed naturally on a surface of an electrodeposited copper foil under an optical microscope with a magnification of 400×.
Figure 2:
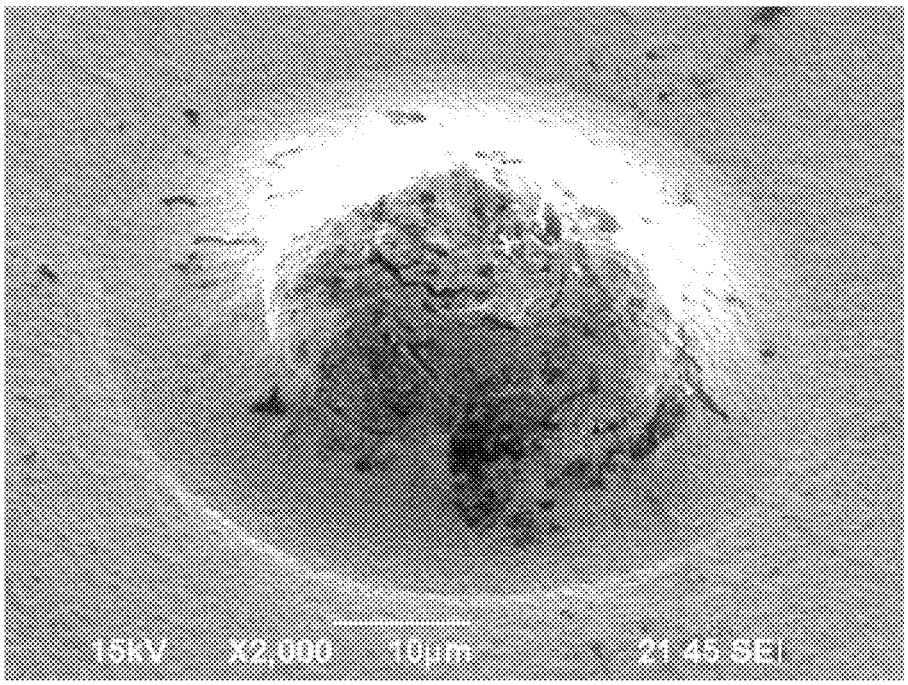
FIG. 2 is an enlarged view showing the nodules formed naturally on a surface of the electrodeposited copper foil under a scanning electronic microscope with a magnification of 2000×.

The purpose of the present invention is to decrease the number of nodules generated on a surface of an electrodeposited copper foil, wherein the nodules are generated on the M surface of the copper foil during the production of the electrodeposited copper foil. As shown in FIG. 1, the nodules formed naturally on a surface of an electrodeposited copper foil are protrusions formed naturally on the surface of the copper foil, rather than depositions of extraneous materials. Generally speaking, the sizes of the nodules range from 5 to 100 μm, and a size of 5 μm or below belongs to description of roughness. Further, as shown in FIG. 2, which shows an enlarged view under a scanning electronic microscope with a magnification of 2000×, the nodules are about 40 μm in size, and appear in truncated conical shapes. Moreover, one of ordinary skill in the art can observe the natural formation of nodules on the surface of the electrodeposited copper foil with a naked eye. Moreover, as compared with a conventional electrodeposited copper foils, substantial decreases in the number of the nodules are clearly observed in the nodules formed naturally on the surfaces of the electrodeposited copper foils provided in the examples of the present invention.

The preparation of an electrodeposited copper foil of the present invention is conducted by the followings. An aqueous solution of sulfuric acid and copper sulfate is used as an electrolyte, and a titanium-made roller is used as a cathodic drum. A direct current is applied between an anode and a cathode to electrically precipitate the copper ions in the electrolyte onto the cathodic drum to form the electrodeposited copper foil, and then the precipitated electrodeposited copper foil is peeled off from the surface of the cathodic drum, and continuously rolled up. In the present invention, the surface of the electrodeposited copper foil in contact with the surface of the cathodic drum is called "glossy surface (S surface)," and the reversed surface is called "rough surface (M surface)."

Conventionally, an organic additive (for example, a low-molecular-weight gel (such as gelatin), hydroxymethyl cellulose (HEC) or polyethylene glycol (PEG)) or a sulfur-containing compound (for example, sodium 3-mercaptopropane sulphonate (MPS), bis-(3-soldiumsulfopropyl disulfide) (SPS)), and a complexing agent (for example, chlorine ions) are added to the copper sulfate electrolyte. However, in the present invention, the addition of thiourea at a concentration of from 0.1 to 2.5 ppm to the copper sulfate electrolyte is found to bring an unexpected effect.

In one embodiment, gelatin, MPS, chlorine ions, and 0.1 to 2.5 ppm of thiourea are added to the copper sulfate electrolyte. The number of the nodules naturally formed on the surface of the obtained electrodeposited copper foil is substantially decreased, wherein the texture coefficient of the plane (200) of the electrodeposited copper sulfate is 50%, 55% or above, 57% or above, or even 80% or above, based on the sum of the texture coefficients of the planes (110), (200), (220) and (311). Preferably, the texture coefficient of the plane (200) of the electrodeposited copper sulfate is from 62 to 75%, based on the sum of the texture coefficients of the planes (110), (200), (220) and (311).

Further, the electrodeposited copper foil has excellent tensile strength and rate of elongation, and the roughness of each of the S and M surfaces is below 2 μm.

EXAMPLES

Example 1

Preparation of an Electrodeposited Copper Foil of the Present Invention

Copper wires were dissolved in an aqueous solution of 50 wt % of sulfuric acid to prepare a copper sulfate electrolyte containing 320 g/L of copper sulfate ($CuSO_4.5H_2O$) and 110 g/L of sulfuric acid. To every liter of the copper sulfate electrolyte, 5.5 mg of a low-molecular-weight gel (DV, manufactured by Nippi, Inc.), 3 mg of sodium 3-mercapto-propane sulphonate (MPS, manufactured by Hopax Chemicals Manufacturing Company Ltd.), 25 mg of hydrochloric acid (manufactured by RCI Labscan Ltd.), and 0.1 mg of thiourea (manufactured by Panreac Quimica Sau) were added.

Then, a electrodeposited copper foil with thickness of 8 μm was prepared at a liquid temperature of 50° C. and a current density of 50 A/dm$^2$. The roughness, tensile strength, and rate of elongation of the electrodeposited copper foil of the present invention, and the number of nodules on the electrodeposited copper foil were measured. The structure of the crystalline phase of the electrodeposited copper foil prepared in example 1 was determined by using an X-ray powder diffractometer, and the texture coefficient thereof was calculated. Results are recorded in Table 1.

Examples 2 to 10

Preparations of the Electrodeposited Copper Foils of the Present Invention

The steps in example 1 were repeated, except that the amounts of thiourea added and the thicknesses of the electrodeposited copper foils prepared in examples 2 to 10 are as shown in Table 1. Results of tests on the electrodeposited copper foils of examples 2 to 10 are also recorded in Table 1.

COMPARATIVE EXAMPLES

Comparative Example 1

Preparation of an Electrodeposited Copper Foil

Copper wires were dissolved in an aqueous solution of 50 wt % of sulfuric acid to prepare a copper sulfate electrolyte containing 320 g/L of copper sulfate ($CuSO_4.5H_2O$) and 110 g/L of sulfuric acid. To every liter of the copper sulfate electrolyte, 5.5 mg of a low-molecular-weight gel (DV, manufactured by Nippi, Inc.), 3 mg of sodium 3-mercapto-propane sulphonate (MPS, manufactured by Hopax Chemicals Manufacturing Company Ltd.), 25 mg of hydrochloric acid (manufactured by RCI Labscan Ltd.), and 0.01 mg of thiourea (manufactured by Panreac Quimica Sau) were added.

Then, an electrodeposited copper foil with thickness of 8 μm was prepared at a liquid temperature of 50° C. and a current density of 50 A/dm$^2$. The roughness, tensile strength, and rate of elongation of the electrodeposited copper foil of the present invention, and the number of nodules on the electrodeposited copper foil were measured. The structure of the crystalline phase of the electrodeposited copper foil prepared in example 1 was determined by using an X-ray powder diffractometer, and the texture coefficient thereof was calculated. Results are recorded in Table 2.

Comparative Examples 2 to 5

Preparations of Electrodeposited Copper Foils

The steps in example 1 were repeated, except that the amounts of thiourea added and the thicknesses of the electrodeposited copper foils prepared in comparative examples 2 to 5 are as shown in Table 2. Results of the tests on the electrodeposited copper foils of comparative examples 2 to 5 are also recorded in Table 2.

Methods of Measurement

Each of electrodeposited copper foils prepared in the aforesaid examples 1 to 10 and comparative examples 1 to 5 were tailored into a test piece with a suitable size for measurements of tensile strength, rate of elongation, and roughness, and a determination of the structure of a crystalline phase by an X-ray powder diffractometer, and then the texture coefficient was calculated. Details of the methods of detection used are provided below.

Tensile Strength

Based on the IPC-TM-650 method, an AG-I type tensile tester manufactured by Shimadzu Corporation was used to tailor each of the electrodeposited copper foils into a test piece with a size of 100 mm in length×12.7 mm in width at room temperature (about 25° C.), and the tensile strength was measured under the conditions of a chuck distance of 50 mm and a crosshead speed of 50 mm/min.

Rate of Elongation

Based on the IPC-TM-650 method, the AG-I type tensile tester manufactured by Shimadzu Corporation was used to tailor each of the electrodeposited copper foils into a test piece with a size of 100 mm in length×12.7 mm in width at room temperature (about 25° C.), and the rate of elongation was measured under the conditions of a chuck distance of 50 mm and a pulling speed of 50 mm/min.

Number of Nodules

Each of the electrodeposited copper foils was peeled off from a titanium-made roller, and an area of 1 square meter was taken from an arbitrary location on the electrodeposited copper foil. The nodules naturally formed on the electrodeposited copper foils were observed with a naked eye.

Test of Roughness (Average Roughness of 10 points, Rz)

According to the IPC-TM-650 method, an α-type surface roughometer (manufactured by Kosaka Laboratory Ltd., Model Type: SE1700) was used to measure the roughness of each of the electrodeposited copper foils.

Test for Thickness

Based on the IPC-TM-650 method, a test piece with a size of 100 mm in length×100 mm in width was tailored from each of the electrodeposited copper foils, and an AG-204 type microbalance manufactured by Mettler Toledo International Inc. was used to measure the test piece. For each of the test pieces, the numerical value in the reading taken was multiplied by 100 to obtain a basis weight (g/m$^2$). A correspondence table of the basis weight and nominal thickness is shown below.

| Basis weight (g/m$^2$) | 54 ± 2.7 | 72 ± 3.6 | 108 ± 5.4 |
|---|---|---|---|
| Thickness (μm) | 6 | 8 | 12 |

Texture Coefficient (TC)

A PW3040-type X-ray powder diffractometer manufactured by PANalytical B.V. was used for analysis, under the conditions of an external voltage of 45 kV, a current of 40 mA, a scanning resolution of 0.04°, and a scanning range (2θ) of from 40° to 95°. The texture coefficient of each of the test pieces was calculated by using the following equation (I):

$$TC(hkl) = \frac{I(hkl)/I_0(hkl)}{(1/n)\sum I(hkl)/I_0(hkl)}. \quad \text{equation (I)}$$

In equation (I), TC(hk1) represents a texture coefficient of a (hk1) crystal plane, the greater the value of TC is, the higher the level of preferred orientation of the crystal face is; I(hk1) represents the diffraction intensity of the (hk1) crystal plane of the test piece analyzed; $I_0$(hk1) represents the diffraction intensity of the (hk1) crystal plane of standard copper powder, as determined by the American Society of Testing Materials (ASTM) (PDF#040836); and n represents the number of diffraction peaks in the range of a specific diffraction angle (2θ).

TABLE 1

Additive conditions, physical properties and texture coefficients in examples 1 to 10

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Thickness (μm) | 8 | 8 | 8 | 8 | 8 | 8 | 8 | 8 | 6 | 12 |
| Thiourea content (ppm) | 0.1 | 0.3 | 0.5 | 0.7 | 1 | 1.5 | 2 | 2.5 | 1.5 | 1.5 |
| Tensile strength (kg/mm$^2$) | 35.4 | 34.2 | 35.3 | 33.8 | 33.8 | 32.8 | 32.2 | 32.2 | 33.1 | 32.9 |
| Rate of elongation (%) | 7.7 | 8.5 | 8.6 | 8 | 7.9 | 8.2 | 7.6 | 7.6 | 7.2 | 11 |
| Roughness of M surface (Rz) (μm) | 1.28 | 1.47 | 1.49 | 1.51 | 1.63 | 1.4 | 1.66 | 1.58 | 1.47 | 1.52 |
| TC(111) | 0.65 | 0.7 | 0.68 | 0.64 | 0.65 | 0.56 | 0.52 | 0.45 | 0.64 | 0.47 |
| TC(200) | 2.21 | 2.23 | 2.23 | 2.29 | 2.53 | 2.58 | 2.64 | 3.04 | 2.48 | 2.75 |
| TC(220) | 0.70 | 0.58 | 0.63 | 0.66 | 0.51 | 0.55 | 0.53 | 0.33 | 0.58 | 0.52 |
| TC(311) | 0.45 | 0.49 | 0.46 | 0.41 | 0.32 | 0.31 | 0.31 | 0.18 | 0.30 | 0.25 |
| Sum of TC(200)/sum of TCs (%) | 55.11 | 55.75 | 55.75 | 57.25 | 63.09 | 64.50 | 66.00 | 76.00 | 62.00 | 68.92 |
| TC(200)/TC(111) | 3.40 | 3.19 | 3.28 | 3.58 | 3.89 | 4.61 | 5.08 | 6.76 | 3.88 | 5.85 |
| Number of nodules (No./m$^2$) | 5 | 4 | 3 | 4 | 1 | 1 | 0 | 1 | 2 | 1 |

TABLE 2

Additive conditions, physical properties and texture coefficients in comparative examples 1 to 5

| | Comparative example 1 | Comparative example 2 | Comparative example 3 | Comparative example 4 | Comparative example 5 |
|---|---|---|---|---|---|
| Thickness (μm) | 8 | 8 | 8 | 8 | 8 |
| Thiourea content (ppm) | 0.01 | 0.05 | 3 | 3.5 | 0 |
| Tensile strength (kg/mm$^2$) | 31.8 | 32.6 | 40.3 | 50.2 | 33.5 |
| Rate of elongation (%) | 7.5 | 7.3 | 5.1 | 3.3 | 7.9 |
| Roughness of M surface (Rz) (μm) | 1.66 | 1.48 | 1.33 | 1.42 | 1.36 |
| TC(111) | 0.76 | 0.78 | 0.81 | 0.75 | 0.86 |
| TC(200) | 1.15 | 1.77 | 1.80 | 1.96 | 1.58 |
| TC(220) | 0.95 | 0.75 | 0.75 | 0.66 | 0.74 |
| TC(311) | 1.13 | 0.70 | 0.64 | 0.64 | 0.82 |
| TC(200)/Sum of TCs (%) | 28.82 | 44.25 | 45.00 | 48.88 | 39.50 |
| TC(200)/TC(111) | 1.51 | 2.27 | 2.22 | 2.61 | 1.84 |
| Number of nodules (No./m$^2$) | 10 | 11 | 27 | 33 | 12 |

Figure 3:
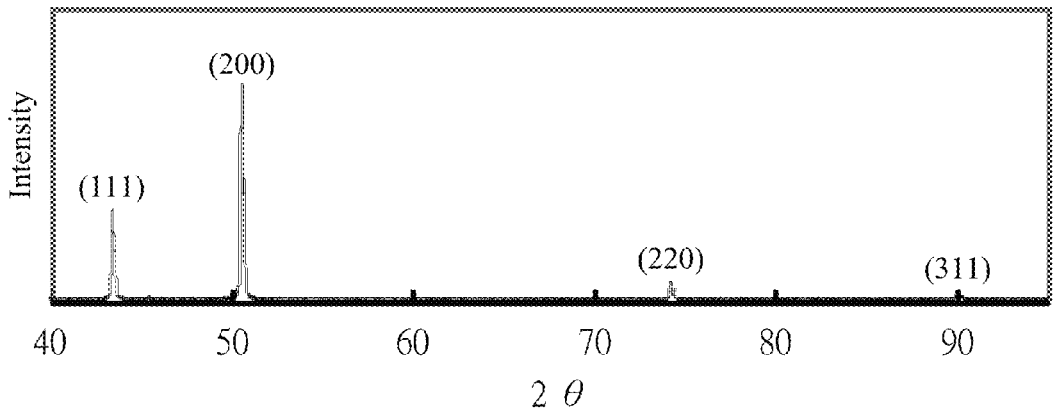
FIG. 3 is a structural diagram showing the crystalline phase of the electrodeposited copper foil of example 6, as measured by an X-ray powder diffractometer.
Figure 4:
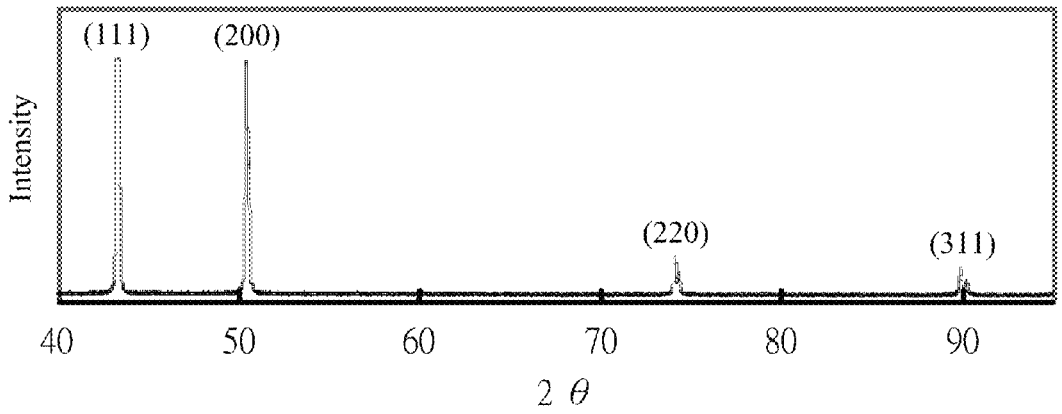
FIG. 4 is a structural diagram showing the crystalline phase of the electrodeposited copper foil of comparative example 2, as measured by the X-ray powder diffractometer.

As shown from the results in tables 1 and 2, in the case that the electrodeposited copper foil of the present invention has a higher texture coefficient at plane (200), the number of nodules observed on the surfaces of the electrodeposited copper foils clearly reduced. The number of nodules per square meter of an electrodeposited copper foil ranged from 0 to 5. The electrodeposited copper foil of example 6 had 1 nodule per square meter, and the structure of the crystalline phase thereof was determined by using an X-ray powder diffractometer. As shown in FIG. 3, the plane (200) of the electrodeposited copper foil obviously took up a higher portion of the structure of the crystalline phase than the planes (111), (220) and (311). By contrast, the electrodeposited copper foil of comparative example 2 had up to 11 nodules per square meter, and the structure of the crystalline phase thereof was determined by using the X-ray powder diffractometer. As shown in FIG. 4, the plane (200) of the electrodeposited copper foil did not clearly take up a higher portion of the structure of the crystalline phase than the plane (111). Moreover, the electrodeposited copper foil of the present invention can maintain excellent tensile strength and rate of elongation, and the roughness of each of the S and M surfaces is lower than 2 μm. In conclusion, in the case that the electrodeposited copper foil has a totally different structure of the crystalline phase, the number of nodules on a surface of the electrodeposited copper foil may be clearly reduced, and thereby providing effective applications in PCBs and lithium ion secondary batteries The foregoing descriptions of the examples are provided only to illustrate the principle and effect of the present invention, and they do not limit the scope of the present invention. It should be understood to one skilled in the art that, modifications and alterations can be made to the examples without departing from the spirit and principle of the present invention. Therefore, the scopes of the present invention should be in concord with the following appended claims. Hence, all of the examples should still fall within the scope encompassed by the technical content disclosed in the present invention, and without affecting the effect brought about by the present invention and the goal to be achieved.

The invention claimed is:

1. An electrodeposited copper foil, comprising a plane (200) with a texture coefficient of from 50 to 80%, based on a sum of texture coefficients of plane (111), the plane (200), a plane (220) and a plane (311) of the electrodeposited copper foil.

2. The electrodeposited copper foil of claim 1, wherein the texture coefficient of the plane (200) is from 62 to 76%, based on the sum of the texture coefficients of the planes (111), (200), (220) and (300) of the electrodeposited copper foil.

3. The electrodeposited copper foil of claim 1, wherein the texture coefficient of the plane (200) to the texture coefficient of the plane (111) are at a ratio ranged from 3 to 7.

4. The electrodeposited copper foil of claim 3, wherein the texture coefficient of the plane (200) to the texture coefficient of the plane (111) are at a ratio of between 3.88 and 6.76.

5. The electrodeposited copper foil of claim 1, which has a tensile strength of between 30 and 40 kgf/mm$^2$.

6. The electrodeposited copper foil of claim 1, further comprising a smooth surface and a rough surface opposing to the smooth surface, and each of the smooth surface and the rough surface has a roughness of lower than 2 μm.

7. The electrodeposited copper foil of claim 1, which has a thickness of greater than or equal to 1 μm.

8. The electrodeposited copper foil of claim 1, further comprising less than or equal to 5 nodules at sizes ranging from 5 to 100 μm per square meter of a surface area of electrodeposited copper foil.

9. An electrodeposited copper foil, comprising less than or equal to 5 nodules at sizes ranging from 5 to 100 μm per square meter of a surface area of the electrodeposited copper foil, and a ratio of a texture coefficient of a plane (200) to a texture coefficient of a plane (111) ranging from 3 to 7.

10. The electrodeposited copper foil of claim 9, wherein the texture coefficient of the plane (200) to the texture coefficient of the plane (111) are at a ratio of between 3.68 and 6.76.

11. The electrodeposited copper foil of claim 9, which has a tensile strength of between 30 and 40 kgf/mm2.

12. The electrodeposited copper foil of claim 9, further comprising a smooth surface and a rough surface opposing to the smooth surface, and each of the smooth surface and the rough surface has a roughness of lower than 2 μm.

13. The electrodeposited copper foil of claim 9, which has a thickness of greater than or equal to 1 μm.

* * * * *